US006656894B2

(12) United States Patent
Peters et al.

(10) Patent No.: US 6,656,894 B2
(45) Date of Patent: Dec. 2, 2003

(54) METHOD FOR CLEANING ETCHER PARTS

(75) Inventors: Darryl W. Peters, Stewartsville, NJ (US); Roberto J. Rovito, Quakertown, PA (US)

(73) Assignee: Ashland Inc., Dublin, OH (US)

( * ) Notice: Subject to any disclaimer, the term of this patent is extended or adjusted under 35 U.S.C. 154(b) by 1 day.

(21) Appl. No.: 09/732,414

(22) Filed: Dec. 7, 2000

(65) Prior Publication Data

US 2002/0107158 A1 Aug. 8, 2002

(51) Int. Cl.[7] ..... C11D 7/52; C11D 7/08

(52) U.S. Cl. ..... 510/175; 510/176; 510/177; 510/504; 438/622; 438/706; 438/708; 438/709; 438/710

(58) Field of Search ..... 510/176, 504, 510/177, 175; 438/622, 706, 708, 709, 710

(56) References Cited

U.S. PATENT DOCUMENTS 5,334,332 A 8/1994 Lee ..... 252/548
5,571,447 A * 11/1996 Ward et al.
5,972,862 A * 10/1999 Torii et al.

* cited by examiner

*Primary Examiner*—Gregory E. Webb
(74) *Attorney, Agent, or Firm*—Martin Connaughton

(57) ABSTRACT

The invention relates to a method useful in removing etch residue from etcher equipment parts. The compositions used are aqueous, acidic compositions containing flouride and polar, organic solvents. The compositions are free of glycols and hydroxyl amine and have a low surface tension and viscosity.

12 Claims, No Drawings

METHOD FOR CLEANING ETCHER PARTS

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

During the fabrication of semiconductor devices it becomes necessary to remove various materials from a substrate. Increasingly, plasma etching, reactive ion etching, ion milling and the like are used as the means of removing material from a substrate. During these removal processes various by-products are formed. These by-products are formed from the interaction of various combinations of plasma gasses, substrate and resist materials. The by-product formation is also influenced by the type of etching equipment and process conditions. For purposes of this invention all the various by-products will be collectively referred to as etch residue. In addition to being redeposited on a substrate etch residues tend to form unwanted deposits on the exposed surfaces of the etching equipment. In an effort to extend the useful life of etching equipment various methods have been proposed for removing the unwanted deposits from the surface of exposed parts of the etching equipment. An example of a method for removing the unwanted residues from etcher parts consists of blasting the surface of the part with small particles such as sand or glass microspheres. Other methods require dipping the etcher parts in a bath. An example of this method is disclosed in U.S. Pat. No. 5,334,332. According to the '332 patent the etcher parts are dipped in a bath comprised of hydroxylamine, an alkanolamine, water and catechol.

BRIEF SUMMARY OF THE INVENTION

The present invention is directed to a method of removing etch residue from etching equipment without damaging the surface of the equipment. The compositions used in the method of the invention are aqueous and free of hydroxyl amine. The aqueous compositions are comprised of an acidic buffer solution, a polar organic solvent that is miscible in all proportions in water, and a fluoride. The compositions have a pH of from about 3 to about 6.

BRIEF DESCRIPTION OF THE SEVERAL VIEWS OF THE DRAWINGS

Not Applicable.

DETAILED DESCRIPTION OF THE INVENTION

The invention is directed to a method of removing built-up etch residues on etching equipment by dipping the etcher parts into an aqueous bath, comprising;

A. an acidic buffer,

B. a polar, organic solvent miscible in all proportions in water, and

C. a fluoride.

The compositions have a pH of from about 3 to about 6 and do not contain hydroxyl amine. According to the invention etcher parts are dipped into a bath comprised of the aqueous cleaning composition. Typically, the temperature of the bath is from 20° C. to about 40° C. Although bath temperatures greater than 40° C. may be used it is not preferred because the useful life of the bath is diminished due to evaporation of water. After a predetermined period of time the etcher parts are removed from the bath and rinsed thoroughly with water either by immersion or spraying. A three to five minute rinse is generally sufficient to remove bath residue. The part is then dried under a stream of inert gas or by heating. Some form of sonication (megasonics or ultrasonics) can optionally be used to agitate the bath.

Preferably, the composition used in the method of the invention is comprised of an acidic buffer solution in an amount necessary to obtain a composition pH of from about 3 to about 6; from about 30% by weight to about 90% by weight of a polar organic solvent that is miscible in all proportions in water; from about 0.1% by weight to about 20% by weight of ammonium fluoride; from about 0.5% by weight to about 40% by weight water; and up to about 15% by weight of a corrosion inhibitor. All weight percents are based on the total weight of the aqueous bath.

A pH of between about 3 and about 9 will allow most sensitive metals to passivate with minimum corrosion. However, in some instances removal of highly inorganic etch residues can require a slightly acidic pH. The pH of the aqueous bath composition used in the method of the invention is adjusted to the desired pH range with an acidic buffer solution. A preferred buffer contains an ammonium salt of carboxylic acid or a polybasic acid. An example of such an ammonium salt is an ammonium salt of acetic acid or phosphoric acid. Especially preferred is the acidic aqueous solution of ammonium acetate and acetic acid. Methods of preparing buffer solutions are well known in the art. The acidic buffer solutions when added to the aqueous bath compositions provide a buffered composition resistant to pH swings and less prone to corrode sensitive metals such as aluminum, used in etcher equipment parts. The polar organic solvents useful in the present invention are those solvents that are miscible in all proportions in water. Dimethylsulfoxide is not a preferred solvent for purposes of this invention due to attendant health risks. Examples of solvents include dimethylacetamide (DMAC), dimethylpyrrolidone (DMPD), monoethanolamine, N-methylethanolamine, formamide, n-methyl formamide, N-methylpyrrolidone (NMP) and the like. DMAC is preferred. The use of DMAC results in a composition having a surface tension of <30 mN/m and a viscosity of about 10 centipoise. This provides for better wetting and greater ease of rinseability.

Fluoride is an essential component of the bath composition. Fluoride containing compositions include those of the general formula $R_1R_2R_3R_4NF$ where $R_1$, $R_2$, $R_3$ and $R_4$ are independently hydrogen, an alcohol group, an alkoxy group, an alkyl group or mixtures thereof. Examples of such compositions include ammonium fluoride, tetramethyl ammonium fluoride and tetraethyl ammonium fluoride. Fluoroboric acid can also be used. Ammonium fluoride is preferred and is available commercially as a 40% aqueous solution.

Water is present coincidentally as a component of other elements such as an aqueous ammonium fluoride solution or it can be added separately. The presence of water improves the the solubility of ammonium fluoride in the bath and aids in the removal of inorganic etch residues.

Glycols and other solvents that would raise the surface tension measured at 25° C. to >40 mN/m and increase the viscosity to >40 cps at 25° C. are not included in the bath composition.

Corrosion inhibitors in an amount up to 15% by weight can be added to the aqueous bath. Preferably, the inhibitor concentration is from about 0.5% by weight to about 8% by weight. Corrosion inhibitors known in the art such as those disclosed in U.S. Pat. 5,417,877 which are incorporated herein by reference, can be used. It has been found that inhibitors with a pKa greater than 6 do not function as well as corrosion inhibitors with a pKa of less than 6 in systems having a pH of less than 6. Therefore, preferred inhibitor compositions are those having a pKa of less than about 6. Examples of preferred inhibitors include anthranilic acid, gallic acid, benzoic acid, p-toluene sulfonic acid, dodecylbenzene sulfonic acid, isophthalic acid, maleic acid, fumaric acid, D,L-malic acid, malonic acid, phthalic acid, maleic anhydride, phthalic anhydride and the like. Examples of inhibitors that may be used but are not preferred include catechol, pyrogallol, and esters of gallic acid.

The aqueous bath compositions used in the method to remove etch residues are non-corrosive to etcher parts, non-flammable and of low toxicity. The aqueous bath compositions effectively remove etch residue at temperatures as low as 20° C. and due to their low surface tension and viscosity are easily rinsed from etcher parts.

The method of the invention is carried out by contacting an etcher part having an organic or metallo-organic polymer, inorganic salt, oxide, hydroxide, or complex or combination thereof present as a film or residue with the disclosed aqueous bath. The actual conditions, e.g. temperature, time, etc depend on the nature and the thickness of the etch residue to be removed. In general, when it is desired to remove etch residue, the part is dipped into a vessel containing the aqueous bath at a temperature from about 20° C. to about 80° C., preferably from about 20° C. to about 40° C. for a period of several minutes to more than twenty four hours depending on the type of residue and amount of buildup.

Having described the invention, the following examples are provided to further illustrate and are not intended to limit the present invention. In the examples below, pH deteremi-nations were made using 5% aqueous solutions at room temperature. Surface tension and viscosity measurements were made at 25° C. The following compositions were prepared by mixing at room temperature.

EXAMPLE 1

| Component | wt % |
|---|---|
| DMAC | 57.5 |
| Water(deionized) | 12.4 |
| Ammonium fluoride(40% aq) | 2.5 |
| Acetic acid(glacial) | 12.0 |
| Ammonium acetate | 15.6 |

EXAMPLE 2

| Component | wt % |
|---|---|
| NMP | 57.5 |
| Water(deionized) | 12.4 |
| Ammonium fluoride(40% aq) | 2.5 |
| Acetic acid(glacial) | 12.0 |
| Ammonium acetate | 15.6 |

EXAMPLE 3

| Component | wt % |
|---|---|
| DMPD | 57.5 |
| Water(deionized) | 12.4 |
| Ammonium fluoride(40% aq) | 2.5 |
| Acetic acid(glacial) | 12.0 |
| Ammonium acetate | 15.6 |

The pH of the composition was 4.75. The surface tension of the composition was 31.5 m/Nm. The viscosity of the composition 18.0 cps.

We claim:

1. A method for removing etch residue from etcher equipment parts, comprising; placing the etcher equipment parts in an aqueous bath, comprising;

A. an acidic buffer,

B. a polar organic solvent miscible in all proportions in water, and

C. a fluoride, until the etch residue is removed, where the bath has a pH of about 3 to about 6 and does not contain hydroxyl amine.

2. The method of claim 1, wherein the aqueous bath further comprises a corrosion inhibitor.

3. The method of claim 1, wherein the acidic buffer contains an ammonium salt of a carboxylic acid or a polybasic acid.

4. The method of claim 1, wherein the polar organic solvent is monoethanolamine, n-methylethanolamine, formamide, n-methylformamide, dimethylacetamide, dimethylpyrrolidone, N-methylpyrrolidone, or mixtures thereof.

5. The method of claim 1, where the fluoride has a general formula $R_1R_2R_3R_4NF$, where $R_1$, $R_2$, $R_3$, and $R_4$ are independently hydrogen, an alcohol group, an alkoxy group, or an alkyl group.

6. The method of claim 2, where the corrosion inhibitor has a pKa of less than about 6.

7. The method of claim 2, wherein the corrosion inhibitor is anthranilic acid, gallic acid, benzoic acid, p-toluene sulfonic acid, dodecylbenzene sulfonic acid, malonic acid, maleic acid, fumaric acid, D,L-malic acid, isophthalic acid, phthalic acid, maleic anhydride, phthalic anhydride, or mixtures thereof.

8. The method of claim 3, where the acidic buffer is a solution of ammonium acetate and acetic acid.

9. The method of claim 1, where the fluoride is fluoroboric acid.

10. The method of claim 5, where the fluoride is ammonium flouride, tetramethyl ammonium fluoride, or tetraethyl ammonium fluoride.

11. The method of claim 1, where the aqueous bath has a surface tension less than or equal to 30 mN/m and a viscosity of less than or equal to 15 centipoise.

12. The method of claim 1, wherein the aqueous bath is agitated.

* * * * *